US005691119A

United States Patent [19]

Mydlarz et al.

[11] Patent Number: 5,691,119

[45] Date of Patent: Nov. 25, 1997

[54] PROCESS FOR PREPARATION OF DIGITALLY IMAGING HIGH CHLORIDE EMULSIONS

[75] Inventors: Jerzy Mydlarz; Jerzy Antoni Budz, both of Fairport, N.Y.

[73] Assignee: Eastman Kodak Company, Rochester, N.Y.

[21] Appl. No.: 601,513

[22] Filed: Feb. 14, 1996

Related U.S. Application Data

[60] Provisional application No. 60/000,460, Jun. 23, 1995.

[51] Int. Cl.[6] ..... G03C 1/035; G03C 1/09; G03C 7/00

[52] U.S. Cl. ..... 430/363; 430/567; 430/494; 430/945; 430/570; 430/603; 430/605

[58] Field of Search ..... 430/567, 363, 430/494, 945, 570, 603, 605

[56] References Cited

U.S. PATENT DOCUMENTS

| | | | |
|---|---|---|---|
| 4,269,927 | 5/1981 | Atwell | 430/217 |
| 4,888,272 | 12/1989 | Kishida et al. | 430/569 |
| 4,983,509 | 1/1991 | Inoue et al. | 430/627 |
| 5,057,405 | 10/1991 | Shiba et al. | 430/505 |
| 5,141,845 | 8/1992 | Brugger et al. | 430/569 |
| 5,196,300 | 3/1993 | Urabe et al. | 430/568 |
| 5,200,310 | 4/1993 | Ohshima | 430/567 |
| 5,204,235 | 4/1993 | Yamamoto et al. | 430/569 |
| 5,223,388 | 6/1993 | Saitou | 430/569 |
| 5,227,286 | 7/1993 | Kuno et al. | 430/539 |
| 5,260,176 | 11/1993 | Otani et al. | 430/563 |
| 5,264,338 | 11/1993 | Urabe et al. | 430/568 |
| 5,314,798 | 5/1994 | Brust et al. | 430/567 |
| 5,393,653 | 2/1995 | Kawai | 430/569 |
| 5,399,475 | 3/1995 | Hasebe et al. | 430/567 |
| 5,451,490 | 9/1995 | Budz et al. | 430/567 |

FOREIGN PATENT DOCUMENTS

| | | | |
|---|---|---|---|
| 0 617 318 | 9/1994 | European Pat. Off. | G03C 1/005 |

*Primary Examiner*—Mark F. Huff
*Attorney, Agent, or Firm*—Paul A. Leipold

[57] ABSTRACT

The invention provides a method of treating silver chloride emulsions comprising providing a silver chloride emulsion, adding gold and sulfur chemical sensitizers, heating to chemically sensitize said emulsion, cooling to below about 50° C., adding bromide to the emulsion and then after bromide addition adding spectral sensitizing dye.

25 Claims, 1 Drawing Sheet

PROCESS FOR PREPARATION OF DIGITALLY IMAGING HIGH CHLORIDE EMULSIONS

CROSS REFERENCE TO RELATED APPLICATION

Reference is made to and priority claimed from U.S. Provisional Application Ser. No. 60/000,460, filed 23 Jun. 1995, entitled PROCESS FOR PREPARATION OF DIGITALLY IMAGING HIGH CHLORIDE EMULSIONS.

FIELD OF THE INVENTION

The invention relates to a process of chemically and spectrally sensitizing a high chloride emulsion having gold sulfide on the surface of said grain and suitable for fast, high volume optical printers and electronic printing devices in which a recording element containing said high chloride silver halide emulsion is subjected to short duration, high energy exposure in a pixel-by-pixel mode.

BACKGROUND OF THE INVENTION

Many known imaging systems require that a hard copy be provided from high speed optical printer or from an image which is in digital form. A typical example of such a system is electronic printing of photographic images which involves control of individual pixel exposure. Such a system provides greater flexibility and the opportunity for improved print quality in comparison to conventional optical methods of photographic printing. In a typical electronic printing method, an original image is first scanned to create a digital representation of the original scene. The data obtained is usually electronically enhanced to achieve desired effects such as increased image sharpness, reduced graininess and color correction. The exposure data is then provided to an electronic printer which reconstructs the data into a photographic print by means of small discrete elements (pixels) that together constitute an image. In a conventional electronic printing method, the recording element is scanned by one or more high energy beams to provide a short duration exposure in a pixel-by-pixel mode using a suitable source such as a cathode ray tube (CRT), light emitting diode (LED) or laser. Such methods are described in the patent literature, including, for example, Hioki U.S. Pat. No. 5,126,235; European Patent Application 479 167 A1 and European Patent Application 502 508 A1. Also, many of the basic principles of electronic printing are provided in Hunt, *The Reproduction of Colour*, Fourth Edition, pages 306–307, (1987).

Silver halide emulsions having high chloride content, i.e., greater than 50 mole percent chloride based on silver, are known to be very desirable in image-forming systems due to the high solubility of silver chloride which permits short processing times and provides less environmentally polluting effluents. In describing an photographic image gradation exposures of the photographic materials are commonly used. Such an image lies between the minimum density (Dmin) and maximum density (Dmax) with the sensitivity to exposing light near the maximum density often referred to as a "shoulder" of the sensitometric curve. Unfortunately, it is very difficult to provide a high chloride silver halide emulsion having high shoulder sensitivity desired in many image-forming processes. Furthermore, conventional emulsions having high chloride contents exhibit significant losses in shoulder sensitivity when they are subjected to high energy, short duration exposures of the type used in high speed optical printers and electronic printing methods of the type described previously herein. Such shoulder sensitivity losses are typically referred to as high intensity shoulder reciprocity failure.

It is known that silver halide emulsions high in silver chloride content do not provide emulsions high in sensitivity and high in gradation. Further the emulsions exhibit reciprocity law failure. That is, the change of sensitivity and gradation due to a change in illuminance of exposure is great.

In order to improve silver halide emulsions high in silver chloride content, various techniques have been proposed.

JP-A ("JP-A" means unexamined published Japanese patent application) No. 26837/1989 discloses that a high-silver-chloride emulsion, whose grains have regions rich in silver bromide near the vertices gives high optical sensitivity and gradation and stable performance.

Ogawa et al U.S. Pat. Nos. 4,786,588 and 4,791,053 disclose transhalogenation of high chloride nontabular grains by the addition of bromide ions. Transhalogenation combined with the use of a sulfur sensitizer or at least one spectral sensitizing dye is taught.

Hasebe et al U.S. Pat. Nos. 4,820,624 and 4,865,962 disclose producing emulsions containing grains that exhibit corner development by starting with a cubic or tetradecahedral host grain emulsion and adding silver bromide and spectral sensitizing dye or sulfur and gold sensitizing in the presence of an adsorbed organic compound.

Sugimoto and Miyake, "Mechanism of Halide Conversion Process of Colloidal AgCl Microcrystals by Br-Ions", Parts I and II, Journal of Colloidal and Interface Science, Vol. 140, No. Dec. 1990, pp. 335–361, report observations of silver bromide deposition selectively onto the edges and corners of host cubic high chloride grains.

Techniques that result in the formation of silver bromide more or less uniformly over surfaces of silver chloride host grains are disclosed by Houle et al. U.S. Pat. No. 5,035,992; Japanese published applications (Kokai) 252649-A (priority 02.03.90-JP 051165 Japan) and 288143-A (priority 04.04.90-JP 089380 Japan).

Ohshima U.S. Pat. No. 5,200,310 discloses a silver halide photographic material having a photosensitive emulsion layer on a base, comprising a high-chloride silver chlorobromide emulsion which is obtained by mixing silver halide host grains with silver halide fine grains and then ripening, thereby forming, on or near surfaces of silver halide grains, silver bromide localized phases, wherein the formation of the localized phases or the chemical sensitization of the surfaces is carried out at a limited temperature. The disclosure discribed provides a silver halide photographic material suitable for rapid processing, high in sensitivity, and good in safelight aptitude and abrasion pressure resistance.

U.S. Pat. No. 5,141,845 issued to Brugger et al. discloses a process for spectral sensitization of photographic silver halide emulsions which comprises forming a shell of silver halide on the chemically sensitized grains. In a comparative example, after 60 minutes at 40° C. a shell of silver bromide crystals is precipitated onto silver chloride crystals by adding concurrently a proper amount of silver nitrate and potassium bromide solution.

Maskasky U.S. Pat. No. 4,435,501 discloses the selective site epitaxial deposition onto high aspect ratio tabular grains through the use of a site director. Example site directors include various cyanine spectral sensitizing dyes and adenine. In Example 24B silver bromide was deposited epitaxially onto the edges of high chloride tabular grains.

Emulsion precipitation was conducted at a temperature of 55° C. while using a benzoxazolium spectral sensitizing dye as a site director for epitaxial deposition of bromide on silver chloride host grain.

Maskasky U.S. Pat. No. 5,275,930 discloses a chemically sensitized high chloride tabular grain emulsion. The tabular grains have {100} major faces. Chemically sensitized silver halide epitaxial deposits containing less than 75 percent of the chloride ion concentration of the tabular grains and accounting for less than 20 percent of total silver are located at one or more of the corners of tabular grains. The emulsions were prepared by first forming the host silver chloride grains, epitaxially depositing silver bromide, adsorbing a photographically useful compound to the surfaces of silver halide epitaxial deposits, and chemically digesting the emulsion.

In order to increase the output of digital printing devices, such as CRT, LED, or laser-based printers, it is highly desirable to increase toe and shoulder speed of high chloride silver halide emulsions when exposed at very short times even further. In the art of silver chloride-based color paper preparation it is the red color record that has the worst shoulder reciprocity performance.

Kuno U.S. Pat. No. 5,227,286 discloses chlorobromide emulsions for short time exposures. Four-way interaction of gel laydown and silver laydown and high chloride and iridium doping is claimed to improve efficiency of this system using xenon lamp flash exposure at short exposure time ($10^{-5}$ sec). Conventional sulfur-plus-gold chemical sensitization was used to chemically digest all emulsions. Emulsions described in that patent contain ca. 0.05 mol % iodide (introduced at the end of precipitation).

U.S. Pat. No. 4,983,509 is one example of core-shell silver bromoiodide grains for short time exposures. Whereas mixed bromoiodide emulsions yield good reciprocity and efficiency, they possess a disadvantage of being not suitable for rapid-access, ecologically desired processes.

PROBLEM TO BE SOLVED BY THE INVENTION

In the light of the previous discussion, it is evident that it is highly desirable to provide a process of chemical and spectral sensitization of high chloride emulsion suitable for fast optical printers and electronic printing devices. There is a need for recording elements containing high chloride silver halide emulsions that when subjected to short duration, high energy exposure in a pixel-by-pixel mode are less subject to the disadvantages such as reciprocity failure discussed hereinbefore.

SUMMARY OF THE INVENTION

An object of the invention is to provide color papers that may suitably be exposed at very short exposure times.

Another object of the invention is to provide rapid developing photographic elements that may be exposed at very short exposure times.

These and other objects of the invention may generally be accomplished by providing a method of treating silver chloride emulsions comprising providing a silver chloride emulsion, adding gold and sulfur chemical sensitizers, heating to chemically sensitize said emulsion, cooling to below about 50° C., adding bromide to the emulsion and then after bromide addition adding spectral sensitizing dye.

In another embodiment in accordance with the invention, there is provided an emulsion comprising high chloride silver grains having gold sulfide on the surface of the grains and a bromide rich phase located at the corners. In a further embodiment of the invention a method of imaging is provided in which a photographic element comprising at least one layer of an emulsion comprising high chloride silver halide grains having gold sulfide on the surface of the grains and a bromide rich phase located at the corners and imaging said element utilizing exposure time of less than a hundredth of a second prior to developing to form a high quality image.

ADVANTAGEOUS EFFECT OF THE INVENTION

The process of chemical/spectral sensitization and the photographic element of this invention, as described and claimed hereinafter, provides a solution to the problem of high intensity shoulder reciprocity failure of high chloride emulsions.

DETAILED DESCRIPTION OF THE INVENTION

Figure 1:
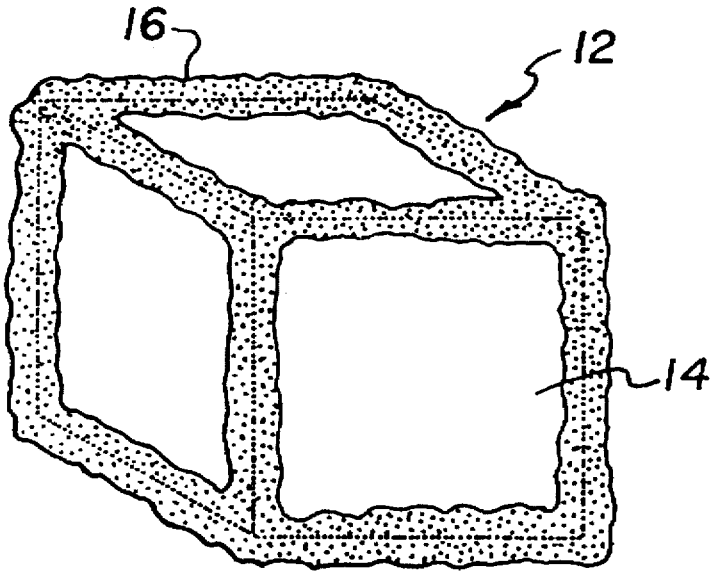
FIG. 1 is a schematic drawing of bromide-rich phase deposition on the corners and edges of AgCl cubic.

The present invention has its purpose in providing a high chloride emulsion that in addition to providing the advantages of conventional emulsions would maximize the efficiency both of the high speed optical printers and the electronic direct printing devices using a process of chemically and spectrally sensitizing said emulsions and a photographic element comprising such emulsions.

In one aspect, this invention is directed to a short time, high intensity radiation sensitive emulsion containing a silver halide grain population comprising at least 50 mole percent of silver chloride, based on silver, wherein each of the grains is comprised of a host silver chloride grain having a bromide rich phase located at the corners and edges.

In another aspect, this invention is directed to emulsions described above which are sensitized with high-gold containing compounds with reduced level of sulfur compounds added to the emulsion.

After a high chloride cube emulsion is produced, the present invention makes possible a high level of photographic shoulder efficiency with improved high intensity reciprocity failure to be achieved. This is accomplished by forming silver halide deposits at the corners and edges of the host grains after chemical but prior to spectral sensitization. It has been discovered that superior photographic performance can be realized when the chloride content of the localized deposits is held below of that of the host grains. This is achieved first by forcing the silver halide deposits to grow at the corners and edges of the host grains. This localized silver halide deposit is achieved by carring out the process of bromide addition at temperatures lower than about 55° C.

The photographic emulsion satisfying the requirements of this invention exhibits exceptionally high levels of photographic efficiency for both optical high speed and digital printers with a very good high intensity reciprocity characteristics, especially at the shoulder portion of the sensitometric curve.

There are two aspects of present invention. In one aspect this invention is directed to a process of chemical and spectral sensitization of a high chloride emulsion comprising addition of bromide after the cooling to below about 50° C. after heating for chemical sensitization. In a second aspect this invention is directed to a method of imaging comprising providing an photographic element, wherein said element comprises at least one emulsion layer comprising high chloride silver halide grains having gold sulfide on the surface of said grain and a bromide rich phase located at the corners, exposing said element to high energy radiation at exposure times of less than about a hundredth of a second, and developing said element to produce a high quality image.

The photographically useful, short time/high intensity radiation sensitive element of the invention is comprised of at least one radiation sensitive high chloride emulsion wherein each grain of the emulsion contains a silver bromide rich phases localized at the corners and edges of the host grains.

A feature that distinguishes the high chloride emulsions of this invention from the conventional high chloride emulsions known in the art is the presence of a highly localized distribution of silver bromide phase. The term "highly localized silver bromide phase" is used here to describe the situation where the bromide is intentionally localized at the outer perimeter of the surfaces of cubic grains by addition after chemical sensitization but prior to the spectral sensitization. It is preferred that an antifoggant is added prior to bromide.

A theory or explanation for "bromide decoration" caused by different addition temperature of bromide is as follows: All reactions taking place on the sensitized crystal surface can be generally described in a similar way as for diffusional model of crystal growth. The kinetics of all reactions taking place on the sensitized crystal surface is temperature dependent. Higher temperatures usually catalyze the sensitization process. In order for grain sensitization to occur, the chemical species must move from the bulk solution to the crystal surface, be adsorbed on the crystal surface, and finally move to a "desired" place on the crystal surface. The latter step is so-called "surface integration". For identical wetting, the nucleation work is lower (i.e., nucleation is easier) on a "rough surface" than on a flat surface; therefore, we can expect that recrystallization of bromide on the silver chloride substrate will take place not on the flat surface, but rather on the corners and edges of the cubic AgCl grains regardless of recystallization temperature. Due to a different bromide concentration on the cubic AgCl grains surface, the bromide species will migrate on the surface (surface diffusion). The kinetics of this process (as of any diffusion process) is temperature dependent. Higher temperature significantly catalyzes this process. Therefore, addition of bromide to the silver chloride host emulsion at high temperature results finally in a very similar non-localized bromide distribution over all surfaces of the AgCl grain. For bromide addition at low temperatures, a high silver bromide phase localized on the corners and edges of the cubic grain is created.

If the silver chloride host emulsion having a high bromide localized phase is heated to and held at the temperatures conventionally employed to achieve chemical sensitization (ca. 65° C.), the silver bromide phase will spread away from the corners and edges of the host grain, unless another compound (preferably photographically useful) strongly adsorbed to the silver halide grain surfaces is added. A wide choice of photographic compounds are available from among conventional spectral sensitizing dyes, antifoggants and stabilizers.

As demonstrated in the Examples below the advantage of bromide addition at lower temperature and after the chemical sensitization is completed lie in forming a stable high bromide localized phase on the corners and edges of the host grain.

The high bromide localized phase can be described as the nonuniformity of the bromide distribution on the grain surface. The nonuniformity of the bromide distribution is controlled by the temperature at which bromide is introduced in forming the high bromide localized phase. The existence of such a phase can be determined visually by careful examination of scanning electron micrographs, as schematically drawn in FIG. 1.

In the preferred form of this invention the bromide rich phase accounts for more than 70 percent of the silver bromide present on the surface of the high chloride grains. Optimally the bromide rich phase accounts for 90 to 95% percent of the silver bromide present on the surface of high chloride grains. However, the bromide rich phase can account for a higher proportion (e.g., up to 100 percent) of the silver bromide present.

For rapid access processes, as used in the art for high chloride emulsions, it is suitable to include less than 2.0 percent of the silver forming the grain as silver bromide, and less than 1.1% silver bromide based on total silver is preferred for rapid development preferred.

As illustrated in FIG. 1, a cubic grain, such as formed by the process of the invention and in existing in the emulsions of the invention, comprises cubic grain 12 comprising faces 14 on which gold sulfide has been deposited as part of chemical sensitization. The grain further comprises deposits 16 of high bromide silver halide which have been deposited after chemical sensitization and cooling of the emulsion after the chemical sensitization with the gold sulfide.

Figure 2:
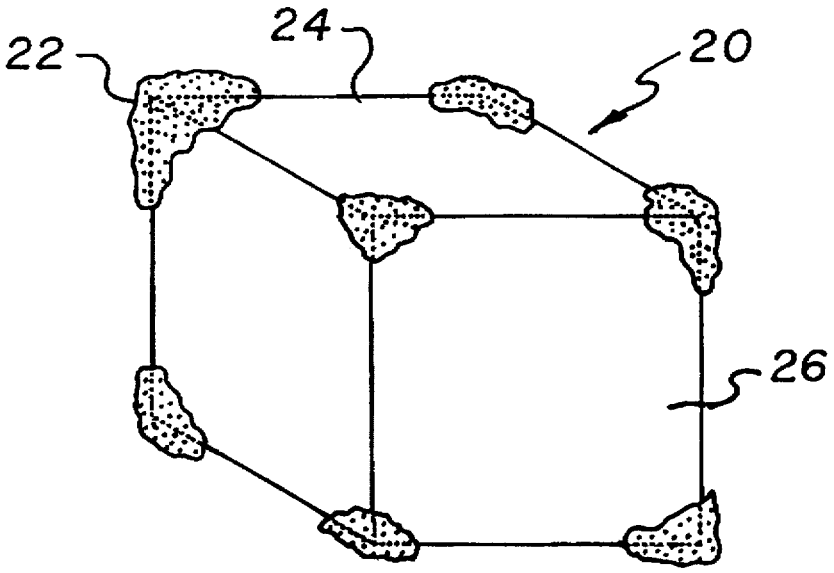
FIG. 2 is a schematic drawing of a bromide-rich phase deposition on the corners of a silver chloride cubic grain.

FIG. 2 illustrates another grain that is in accordance with the invention. This grain 20 has been subjected to treatment by a low amount of bromide and the bromide deposits 22 at the corners such as 22 rather than engulfing the edges such as 24. The faces 26, are treated with the gold sulfide during chemical sensitization. While it is preferred that the edges be substantially covered with the bromide rich silver halide, the invention advantages are also seen with corner deposition only such as in FIG. 2.

The grains of the invention are gold and sulfur sensitized. Suitable materials for the gold and sulfur sensitization are discussed in *Research Disclosure,* 308119, December 1989, page 996. Preferred material for gold and sulfur sensitization is gold sulfide, as use of gold sulfide, as use of gold sulfide results in rapid chemical sensitization for good sensitivity performance.

While it is demonstrated in the Examples below that the bromide rich phase located at the corners and edges dramatically improves the high intensity reciprocity failure of the emulsions of the invention as compared to high chloride emulsions having more uniform bromide distributions, the mechanism by which shoulder reciprocity has been improved is not known with certainty. It can be stated with some confidence that the latent image is preferably formed at the corners and edges of the cubic grains. For bromide addition at lower temperatures a high silver bromide phase localized at the corners and edges of the host grain is created, thus providing a different substrate for subsequent spectral sensitization reactions. The silver bromide phase adsorbs the red spectral sensitizing dye much better than the silver chloride phase (T. H. James,. "*Theory of the Photographic Process*", 4th edition, Macmillan Publishing Co., New York 1988). Having bromide rich phase located at the same region where the latent image is preferably formed, the photoefficiency is significantly improved particularly for a very short exposure times (e.g., there is less reciprocity failure).

The invention may be practiced with any of the known techniques for emulsion preparation. Such techniques include those which are normally utilized, for instance, single jet or double jet precipitation; or they may include forming a silver halide emulsion by the nucleation of silver halide grains in a separate mixer or first container with later growth in a second container. All these techniques are referenced in the patents discussed in *Research Disclosure*, 308119, December 1989, Sections I–IV at pages 993–1000.

The dispersing medium contained in the reaction vessel prior to the nucleation step is comprised of water, the dissolved chloride ions and a peptizer. The dispersing medium can exhibit a pH within any convenient conventional range for silver halide precipitation, typically from 2 to 8. It is preferred, but not required, to maintain the pH of the dispersing medium on the acid side of neutrality (i.e., <7.0). To minimize fog a preferred pH range for precipitation is from 2.0 to 5.0. Mineral acids, such as nitric acid or hydrochloride acid, and bases, such as alkali hydroxides, can be used to adjust the pH of the dispersing medium. It is also possible to incorporate pH buffers.

The peptizer can take any convenient conventional form known to be useful in the precipitation of photographic silver halide emulsions. A summary of conventional peptizers is provided in *Research Disclosure*, Vol. 308, December 1989, Item 308119, Section IX. *Research Disclosure* is published by Kenneth Mason Publications, Ltd., Emsworth, Hampshire P010 7DD, England. While synthetic polymeric peptizers of the type disclosed by Maskasky U.S. Pat. No. 4,400,463, can be employed, it is preferred to employ gelatino peptizers (e.g., gelatin and gelatin derivatives). As manufactured and employed in photography gelatino peptizers typically contain significant concentrations of calcium ion, although the use of deionized gelatino peptizers is a known practice. In the latter instance it is preferred to compensate for calcium ion removal by adding divalent or trivalent metal ions, such alkaline earth or earth metal ions, preferably magnesium, calcium, barium or aluminum ions. Specifically preferred peptizers are low methionine gelatino peptizers (i.e., those containing less than 30 micromoles of methionine per gram of peptizer), optimally less than 12 micromoles of methionine per gram of peptizer. These peptizers and their preparation are described by Maskasky U.S. Pat. No. 4,713,323 and King et al U.S. 4,942,120. It is conventional practice to add gelatin, gelatin derivatives and other vehicles and vehicle extenders to prepare emulsions for coating after precipitation. Any naturally occurring level of methionine can be present in gelatin and gelatin derivatives added after precipitation is complete; however, low levels of methionine (as in oxidized gelatins) are preferred.

The nucleation step can be performed at any convenient conventional temperature for the precipitation of silver halide emulsions. Temperatures ranging from near ambient—e.g., 30° C. up to about 90° C. are contemplated, with nucleation temperatures in the range of from 35° to 70° C. being preferred.

It is usually preferred to prepare photographic emulsions with the most geometrically uniform grain populations attainable, since this allows a higher percentage of the grain population to be optimally sensitized and otherwise optimally prepared for photographic use. Further, it is usually more convenient to blend relatively monodisperse emulsions to obtain aim sensitometric profiles than to precipitate a single polydisperse emulsion that conforms to an aim profile.

If desired, the ripening can be introduced by the presence of a ripening agent in the emulsion during precipitation. A conventional simple approach to accelerating ripening is to increase the halide ion concentration in the dispersing medium. This creates complexes of silver ions with plural halide ions that accelerate ripening. When this approach is employed, it is preferred to increase the chloride ion concentration in the dispersing medium. That is, it is preferred to lower the pCl of the dispersing medium into a range in which increased silver chloride solubility is observed. Alternatively, ripening can be effected by employing conventional ripening agents. Preferred ripening agents are sulfur containing ripening agents, such as thioethers and thiocyanates. Typical thiocyanate ripening agents are disclosed by Nietz et al U.S. Pat. No. 2,222,264, Lowe et al U.S. Pat. No. 2,448,534 and Illingsworth U.S. Pat. No. 3,320,069, the disclosures of which are here incorporated by reference. Typical thioether ripening agents are disclosed by McBride U.S. Pat. No. 3,271,157, Jones U.S. Pat. No. 3,574,628 and Rosencrantz et al U.S. Pat. No. 3,737,313, the disclosures of which are here incorporated by reference. More recently crown thioethers have been suggested for use as ripening agents. Ripening agents containing a primary or secondary amino moiety, such as imidazole, glycine or a substituted derivative, are also effective.

During the growth step both silver and halide salts are preferably introduced into the dispersing medium. In other words, double jet precipitation is contemplated. The rate at which silver and halide salts are introduced is controlled to avoid renucleation—that is, the formation of a new grain population. Addition rate control to avoid renucleation is generally well known in the art, as illustrated by Wilgus German OLS No. 2,107,118, Irie U.S. Pat. No. 3,650,757, Kurz U.S. Pat. No. 3,672,900, Saito U.S. Pat. No. 4,242,445, Teitschied et al European Patent Application 80102242, and Wey "Growth Mechanism of AgBr Crystals in Gelatin Solution", *Photographic Science and Engineering*, Vol. 21, No. 1, Jan./Feb. 1977, p. 14, et seq.

In the simplest form of the grain preparation the nucleation and growth stages of grain precipitation occur in the same reaction vessel. It is, however, recognized that grain precipitation can be interrupted, particularly after completion of the nucleation stage. Further, two separate reaction vessels can be substituted for the single reaction vessel described herein. The nucleation stage of grain preparation can be performed in an upstream reaction vessel (herein also termed a nucleation reaction vessel) and the dispersed grain nuclei can be transferred to a downstream reaction vessel in which the growth stage of grain precipitation occurs (herein also termed a growth reaction vessel). In one arrangement of this type an enclosed nucleation vessel can be employed to receive and mix reactants upstream of the growth reaction vessel, as illustrated by Posse et al U.S. Pat. No. 3,790,386, Forster et al U.S. Pat. No. 3,897,935, Finnicum et al U.S. Pat. No. 4,147,551, and Verhille et al U.S. Pat. No. 4,171,224, here incorporated by reference. In these arrangements the contents of the Growth reaction vessel are recirculated to the nucleation reaction vessel.

It is herein contemplated that various parameters important to the control of grain formation and growth, such as pH, pAg, ripening, temperature, and residence time, can be independently controlled in the separate nucleation and growth reaction vessels. To allow grain nucleation to be entirely independent of grain growth occurring in the growth reaction vessel down stream of the nucleation reaction vessel, no portion of the contents of the growth reaction vessel should be recirculated to the nucleation reaction vessel. Preferred arrangements that separate grain nucleation from the contents of the growth reaction vessel are disclosed by Mignot U.S. Pat. No. 4,334,012 (which also discloses the useful feature of ultrafiltration during grain growth), Urabe U.S. Pat. No. 4,879,208 and published European Patent Applications 326,852, 326,853, 355,535 and 370,116, Ichizo published European Patent Application 0 368 275, Urabe et al published European Patent Application 0 374 954, and Onishi et al published Japanese Patent Application (Kokai) 172,817-A (1990).

The emulsions used in the recording elements include silver chloride emulsions and silver chlorobromide emulsions. Dopants, in concentrations of up to $10^{-2}$ mole per silver mole and typically less than $10^{-4}$ mole per silver mole, can be present in the grains. Compounds of metals such as copper, thallium, lead, mercury, bismuth, zinc, cadmium, rhenium, and Group VIII metals (e.g., iron, ruthenium, rhodium, palladium, osmium, iridium, and platinum) can be present during grain precipitation, preferably during the growth stage of precipitation. The modification of photographic properties is related to the level and location of the dopant within the grains. When the metal forms a part of a coordination complex, such as a hexacoordination complex or a tetracoordination complex, the ligands can also be included within the grains and the ligands can further influence photographic properties. Coordination ligands, such as halo, aquo, cyano cyanate, thiocyanate, nitrosyl, thionitrosyl, oxo and carbonyl ligands are contemplated and can be relied upon to modify photographic properties.

The high chloride emulsions can be chemically sensitized with active gelatin as illustrated by T. H. James, *The Theory of the Photographic Process*, 4th Ed., Macmillan, 1977, pp. 67–76, or with sulfur, selenium, tellurium, gold, platinum, palladium, iridium, osmium, rhenium or phosphorus sensitizers or combinations of these sensitizers, (particularly combinations of sulfur with gold or selenium), such as at pAg levels of from 5 to 10, pH levels of from 5 to 8 and temperatures of from 30° to 80° C., as illustrated by *Research Disclosure*, Vol. 120, April, 1974, Item 12008, *Research Disclosure*, Vol. 134, June, 1975, Item 13452, Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Patent 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Patent 1,396,696 and Deaton U.S. Pat. No. 5,049,485; the amount of the sulfur sensitizer can be properly selected according to conditions such as grain size, chemical sensitization temperature, pAg, and pH; chemical sensitization being optionally conducted in the presence of thiocyanate derivatives as described in Damschroder U.S. Pat. No. 2,642,361; thioether compounds as disclosed in Lowe et al U.S. Pat. No. 2,521,926, Williams et al U.S. Pat. No. 3,021,215 and Bigelow U.S. Pat. No. 4,054,457; and azaindenes, azapyridazines and azapyrimidines as described in Dostes U.S. Pat. No. 3,411,914, Kuwabara et al U.S. Pat. No. 3,554,757, Oguchi et al U.S. Pat. No. 3,565,631 and Oftedahl U.S. Pat. No. 3,901,714; elemental sulfur as described by Miyoshi et al European Patent Application EP 294,149 and Tanaka et al European Patent Application EP 297,804; and thiosulfonates as described by Nishikawa et al European Patent Application EP 293,917. However, for the emulsions of this invention high gold finishes are used, especially, but not exclusively, when the source of gold sensitizer is a colloidal dispersion of gold sulfide. An alternative source of gold can be any useful source, as practiced in the art, for example, Deaton U.S. Pat. No. 5,049,485. High gold means that the amount of sulfur sensitizer should be less than 4 μmoles per silver mole, and preferably less than 1 μmole per silver mole of the sensitized emulsion. Additionally or alternatively, the emulsions can be reduction-sensitized—e.g., with hydrogen, as illustrated by Janusonis U.S. Pat. No. 3,891,446 and Babcock et al U.S. Pat. No. 3,984,249, by low pAg (e.g., less than 5), high pH (e.g., greater than 8) treatment, or through the use of reducing agents such as stannous chloride, thiourea dioxide, polyamines and amineboranes as illustrated by Allen et al U.S. Pat. No. 2,983,609, Oftedahl et al *Research Disclosure*, Vol. 136, August, 1975, Item 13654, Lowe et al U.S. Pat. Nos. 2,518,698 and 2,739,060, Roberts et al U.S. Pat. Nos. 2,743,182 and 2,743,183, Chambers et al U.S. Pat. No. 3,026,203 and Bigelow et al U.S. Pat. No. 3,361,564.

The emulsions used in the invention can be spectrally sensitized with dyes from a variety of classes, including the polymethine dye class, which includes the cyanines, merocyanines, complex cyanines and merocyanines (i.e., tri-, tetra- and polynuclear cyanines and merocyanines), styryls, merostyryls, streptocyanines, hemicyanines, arylidenes, allopolar cyanines and enamine cyanines.

The cyanine spectral sensitizing dyes include, joined by a methine linkage, two basic heterocyclic nuclei, such as those derived from quinolinium, pyridinium, isoquinolinium, 3H-indolium, benzindolium, oxazolium, thiazolium, selenazolinium, imidazolium, benzoxazolium, benzothiazolium, benzoselenazolium, benzotellurazolium, benzimidazolium, naphthoxazolium, naphthothiazolium, naphthoselenazolium, naphtotellurazolium, thiazolinium, dihydronaphthothiazolium, pyrylium and imidazopyrazinium quaternary salts.

The merocyanine spectral sensitizing dyes include, joined by a methine linkage, a basic heterocyclic nucleus of the cyanine-dye type and an acidic nucleus such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-dioxane-4,6-dione, pyrazolin-3, 5-dione, pentan-2,4-dione, alkylsulfonyl acetonitrile, benzoylacetonitrile, malononitrile, malonamide, isoquinolin-4-one, chroman-2,4-dione, 5H-furan-2-one, 5H-3-pyrrolin-2-one, 1,1,3-tricyanopropene and telluracyclohexanedione.

One or more spectral sensitizing dyes may be employed. Dyes with sensitizing maxima at wavelengths throughout the visible and infrared spectrum and with a great variety of spectral sensitivity curve shapes are known. The choice and relative proportions of dyes depends upon the region of the spectrum to which sensitivity is desired and upon the shape of the spectral sensitivity curve desired. An example of a material which is sensitive in the infrared spectrum is shown in Simpson et al., U.S. Pat. No. 4,619,892, which describes a material which produces cyan, magenta and yellow dyes as a function of exposure in three regions of the infrared spectrum (sometimes referred to as "false" sensitization). Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering*, Vol. 18, 1974, pp. 418–430.

Spectral sensitizing dyes can also affect the emulsions in other ways. For example, spectrally sensitizing dyes can increase photographic speed within the spectral region of inherent sensitivity. Spectral sensitizing dyes can also function as antifoggants or stabilizers, development accelerators or inhibitors, reducing or nucleating agents, and halogen acceptors or electron acceptors, as disclosed in Brooker et al U.S. Pat. No. 2,131,038, Illingsworth et al U.S. Pat. No. 3,501,310, Webster et al U.S. Pat. No. 3,630,749, Spence et al U.S. Pat. No. 3,718,470 and Shiba et al U.S. Pat. No. 3,930,860.

Among useful spectral sensitizing dyes for sensitizing the emulsions described herein are those found in U.K. Patent 742,112, Brooker U.S. Pat. Nos. 1,846,300, 1,846,301, 1,846,302, 1,846,303, 1,846,304, 2,078,233 and 2,089,729, Brooker et al U.S. Pat. Nos. 2,165,338, 2,213,238, 2,493,747, '748, 2,526,632, 2,739,964 (Reissue 24,292), 2,778,823, 2,917,516, 3,352,857, 3,411,916 and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349, the disclosures of which are here incorporated by reference. Examples of useful supersensitizing-dye combinations, of non-light-absorbing addenda which function as supersensitizers or of useful dye combinations are found in McFall et al U.S. Pat. No. 2,933,390, Jones et al U.S. Pat. No. 2,937,089, Motter U.S. Pat. No. 3,506,443 and Schwan et al U.S. Pat. No. 3,672,898, the disclosures of which are here incorporated by reference.

Some amounts of spectral sensitizing dyes may remain in the emulsion layers after processing causing, what is known in the art, dye stain. Specifically designed for low stain dyes are disclosed in *Research Disclosure*, Vol. 362, 1994, Item 36216, Page 291.

Spectral sensitizing dyes can be added at any stage during the emulsion preparation, but very different sensitization can result. In general, the spectral sensitizing dyes may be added at the beginning of or during precipitation as described by Wall,. *Photographic Emulsions*, American Photographic Publishing Co., Boston, 1929, p. 65, Hill U.S. Pat. No. 2,735,766, Philippaerts et al U.S. Pat. No. 3,628,960, Locker U.S. Pat. No. 4,183,756, Locker et al U.S. Pat. No. 4,225,666 and *Research Disclosure*, Vol. 181, May, 1979, Item 18155, and Tani et al published European Patent Application EP 301,508. They can be added prior to or during chemical sensitization as described by Kofron et al U.S. Pat. No. 4,439,520, Dickerson U.S. Pat. No. 4,520,098, Maskasky U.S. Pat. No. 4,435,501 and Philippaerts et al cited above. They can be added before or during emulsion washing as described by Asami et al published European Patent Application EP 287,100 and Metoki et al published European Patent Application EP 291,399. The dyes can be mixed in directly before coating as described by Collins et al U.S. Pat. No. 2,912,343. However, for the emulsions of this invention spectral sensitizing dye is added at lower temperature but after addition of both an antifoggant and silver bromide. Small amounts of iodide can be adsorbed to the emulsion grains to promote aggregation and adsorption of the spectral sensitizing dyes as described by Dickerson cited above. Postprocessing dye stain can be reduced by the proximity to the dyed emulsion layer of fine high-iodide grains as described by Dickerson. Depending on their solubility, the spectral-sensitizing dyes can be added to the emulsion as solutions in water or such solvents as methanol, ethanol, acetone or pyridine; dissolved in surfactant solutions as described by Sakai et al U.S. Pat. No. 3,822,135; or as dispersions as described by Owens et al U.S. Pat. No. 3,469,987 and Japanese published Patent Application (Kokai) 24185/71.

After sensitizing, the emulsion can be combined with any suitable coupler (whether two or four equivalent) and/or coupler dispersants to make the desired color film or print photographic materials; or they can be used in black and white photographic films and print material. Couplers which can be used in accordance with the invention are described in *Research Disclosure*, Vol. 176, 1978, item 17643, Section VIII, Disclosure 308119 Section VII, and in particular in *Research Disclosure*, Vol. 362, 1994, Item 36216, Page 291.

Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Most of the antifoggants effective in the emulsions used in this invention can also be used in developers and can be classified Under a few general headings, as illustrated by C. E. K. Mees, *The Theory of the Photographic Process*, 2nd Ed., Macmillan, 1954, pp. 677–680.

To avoid such instability in emulsion coatings, stabilizers and antifoggants can be employed, such as halide ions (e.g., bromide salts); chloropalladates and chloropalladites as illustrated by Trivelli et al U.S. Pat. No. 2,566,263; water-soluble inorganic salts of magnesium, calcium, cadmium, cobalt, manganese and zinc as illustrated by Jones U.S. Pat. No. 2,839,405 and Sidebotham U.S. Pat. No. 3,488,709; mercury salts as illustrated by Allen et al U.S. Pat. No. 2,728,663; selenols and diselenides as illustrated by Brown et al U.K. Patent 1,336,570 and Pollet et al U.K. Patent 1,282,303; quaternary ammonium salts of the type illustrated by Allen et al U.S. Pat. No. 2,694,716, Brooker et al U.S. Pat. No. 2,131,038, Graham U.S. Pat. No. 3,342,596 and Arai et al U.S. Pat. No. 3,954,478; azomethine desensitizing dyes as illustrated by Thiers et al U.S. Pat. No. 3,630,744; isothiourea derivatives as illustrated by Herz et al U.S. Pat. No. 3,220,839 and Knott et al U.S. Pat. No. 2,514,650; thiazolidines as illustrated by Scavron U.S. Pat. No. 3,565,625; peptide derivatives as illustrated by Maffet U.S. Pat. No. 3,274,002; pyrimidines and 3-pyrazolidones as illustrated by Welsh U.S. Pat. No. 3,161,515 and Hood et al U.S. Pat. No. 2,751,297; azotriazoles and azotetrazoles as illustrated by Baldassarri et al U.S. Pat. No. 3,925,086; azaindenes, particularly tetraazaindenes, as illustrated by Heimbach U.S. Pat. No. 2,444,605, Knott U.S. Pat. No. 2,933,388, Willies U.S. Pat. No. 3,202,512, *Research*

*Disclosure*, Vol. 134, June, 1975, Item 13452, and Vol. 148, August, 1976, Item 14851, and Nepker et al U.K. Patent 1,338,567; mercaptotetrazoles, -triazoles and -diazoles as illustrated by Kendall et al U.S. Pat. No. 2,403,927, Kennard et al U.S. Pat. No. 3,266,897, *Research Disclosure*, Vol. 116, December, 1973, Item 11684, Luckey et al U.S. Pat. No. 3,397,987 and Salesin U.S. Pat. No. 3,708,303; azoles as illustrated by Peterson et al U.S. Pat. No. 2,271,229 and *Research Disclosure*, Item 11684, cited above; purines as illustrated by Sheppard et al U.S. Pat. No. 2,319,090, Birr et al U.S. Pat. No. 2,152,460, *Research Disclosure*, Item 13452, cited above, and Dostes et al French Patent 2,296, 204, polymers of 1,3-dihydroxy (and/or 1,3-carbamoxy)-2-methylenepropane as illustrated by Saleck et al U.S. Pat. No. 3,926,635 and tellurazoles, tellurazolines, tellurazolinium salts and tellurazolium salts as illustrated by Gunther et al U.S. Pat. No. 4,661,438, aromatic oxatellurazinium salts as illustrated by Gunther, U.S. Pat. No. 4,581,330 and Przyklek-Elling et al U.S. Pat. Nos. 4,661,438 and 4,677, 202. High-chloride emulsions can be stabilized by the presence, especially during chemical sensitization, of elemental sulfur as described by Miyoshi et al European published Patent Application EP 294,149 and Tanaka et al European published Patent Application EP 297,804 and thiosulfonates as described by Nishikawa et al European published Patent Application EP 293,917.

In their simplest form, photographic elements of the invention employ a single silver halide emulsion layer containing bromide rich phase on high chloride emulsions and a support. It is, of course, recognized that more than one such silver halide emulsion layer can be usefully included. Where more than one emulsion layer is used, e.g., two emulsion layers, all such layers can be comprised of bromide rich phase on high chloride emulsions grains. However, the use of one or more conventional silver halide emulsion layers, including tabular grain emulsion layers, in combination with one or more high chloride emulsion layers comprising of silver bromide rich phases localized at the corners and edges of the host grains is specifically contemplated.

It is also specifically contemplated to blend the high silver chloride emulsion comprising silver bromide rich phasess localized at the corners and edges of the host grains of the present invention with each other or with conventional emulsions to satisfy specific emulsion layer requirements. Instead of blending emulsions, the same effect can usually be achieved by coating the emulsions to be blended as separate layers in an emulsion unit. For example, coating of separate emulsion layers to achieve exposure latitude is well known in the art. It is further well known in the art that increased photographic speed can be realized when faster and slower silver halide emulsions are coated in separate layers. Typically the faster emulsion layer in an emulsion unit is coated to lie nearer the exposing radiation source than the slower emulsion layer. Coating the faster and slower emulsions in the reverse layer order can change the contrast obtained. This approach can be extended to three or more superimposed emulsion layers in an emulsion unit. Such layer arrangements are specifically contemplated in the practice of this invention.

The recording elements used in this invention can contain brighteners (Section V), antifoggants and stabilizers (Section VI), antistain agents and image dye stabilizers (Section VII I and J), light absorbing and scattering materials (Section VIII), hardeners (Section X), coating aids (Section XI), plasticizers and lubricants (Section XII), antistatic agents (Section XIII), matting agents (Section XVI), and development modifiers (Section XXI), all in *Research Disclosure*, December 1989, Item 308119.

The recording elements used in this invention can be coated on a variety of supports, as described in Section XVII of *Research Disclosure*, December 1989, Item 308119, and references cited therein.

Preferred color paper multilayer format to utilize emulsions of this invention is described in *Reserch Disclosure*, Vol. 362, 1994, Item 36216, Page 291.

The recording elements used in this invention can be exposed to actinic radiation in a pixel-by-pixel mode as more fully described hereinafter to form a latent image and then processed to form a visible image, as described in Sections XVIII and XIX of *Research Disclosure*, December 1989, Item 308119. Typically, processing to form a visible dye image includes the step of contacting the recording element with a color developing agent to reduce developable silver halide and oxidize the color developing agent. Oxidized color developing agent in turn reacts with the coupler to yield a dye. Preferred color developing agents are p-phenylenediamines. Especially preferred are 4-amino-3-methyl-N,N-diethylaniline hydrochloride, 4-amino-3-methyl-N-ethyl-N-(methanesulfonamido)ethylaniline sulfate hydrate, 4-amino-3-methyl-N-ethyl-N-hydroxyethylaniline sulfate, 4-amino-3-(methanesulfonamido)ethyl-N,N-diethylaniline hydrochloride, and 4-amino-N-ethyl-N-(2-methoxyethyl)m-toluidine di-p-toluenesulfonic acid.

With negative-working silver halide, the processing step described hereinbefore provides a negative image. The described elements can be processed in the color paper process Kodak Ektacolor RA-4 or Kodak Flexicolor color process as described in, for example, the British Journal of Photography Annual of 1988, pages 196–198. To provide a positive (or reversal) image, the color development step can be preceded by development with a non-chromogenic developing agent to develop exposed silver halide but not form dye, and then uniform fogging of the element to render unexposed silver halide developable. The Kodak E-6 Process is a typical reversal process. Development is followed by the conventional steps of bleaching, fixing, or bleach-fixing, to remove silver or silver halide, washing, and drying.

The described elements can be also processed in the ionic separation imaging systems which utilize the sulfonamidonaphtol diffusion transfer technology. Such a photographic product comprises at least one image dye providing element comprising at least one layer of photosensitive silver halide emulsion with which is associated a non-diffusible image dye-providing substance. After image-wise exposure, a coating is treated with an alkaline processing composition in the presence of a silver halide developing agent in such a way that for each dye-image forming element, a silver image is developed. An image-wise distribution of oxidized developer cross-oxidizes the molecule of the image dye-providing compound. This, in an alkaline medium, cleaves to liberate a diffusible image dye. A preferred system of this type is disclosed in published in Fleckenstein U.S. trial voluntary protest document B351, 637, dated Jan. 28, 1975. Other patents include: U.S. Pat. No. 4,450,224 and 4,463,080, and U.K. Patents 2,026,710 and 2,038,041.

In a similar technology, a silver halide photographic process is combined with LED exposure and thermal development/transfer resulting in a high image quality hard copy system incorporating digital exposure technology. This is disclosed in many patents including U.S. Pat. Nos. 4,904, 573; 4,952,969; 4,732,846; 4,775,613; 4,439,513; 4,473, 631; 4,603,103; 4,500,626; 4,713,319 (Fujix Pictography).

The recording elements comprising the radiation sensitive silver bromide rich phases localized at the corners and edges of the host grains high chloride emulsion layers according to this invention can be image-wise exposed in a pixel-by-pixel mode using suitable high energy radiation sources typically employed in electronic printing methods. Suitable actinic forms of energy encompass the ultraviolet, visible and infrared regions of the electromagnetic spectrum as well as electron-beam radiation and is conveniently supplied by beams from one or more light emitting diodes or lasers, including gaseous or solid state lasers. Exposures can be monochromatic, orthochromatic or panchromatic. For example, when the recording element is a multilayer multicolor element, exposure can be provided by laser or light emitting diode beams of appropriate spectral radiation, for example, infrared, red, green or blue wavelengths, to which such element is sensitive. Multicolor elements can be employed which produce cyan, magenta and yellow dyes as a function of exposure in separate portions of the electromagnetic spectrum, including at least two portions of the infrared region, as disclosed in the previously mentioned U.S. Pat. No. 4,619,892, incorporated herein by reference. Suitable exposures include those up to 2000 nm, preferably up to 1500 nm. The exposing source need, of course, provides radiation in only one spectral region if the recording element is a monochrome element sensitive to only that region (color) of the electromagnetic spectrum. Suitable light emitting diodes and commercially available laser sources are described in the examples. Imagewise exposures at ambient, elevated or reduced temperatures and/or pressures can be employed within the useful response range of the recording element determined by conventional sensitiometric techniques, as illustrated by T. H. James, *The Theory of the Photographic Process,* 4th Ed., Macmillan, 1977, Chapters 4, 6, 17, 18, and 23.

The quantity or level of high energy actinic radiation provided to the recording medium by the exposure source is generally at least $10^{-4}$ ergs/cm$^2$, typically in the range of about $10^{-4}$ ergs/cm$^2$ to $10^{-3}$ ergs/cm$^2$ and often from $10^{-3}$ ergs/cm$^2$ to $10^2$ ergs/cm$^2$. Exposure of the recording element in a pixel-by-pixel mode as known in the prior art persists for only a very short duration or time. Typical maximum exposure times are up to 100 microseconds, often up to 10 microseconds, and frequently up to only 0.5 microsecond. As illustrated by the following Examples, excellent results are achieved with a laser beam at an exposure time of only 0.05 microsecond, and still lower exposure times down to 0.01 microsecond are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of about $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al., *A Continuous-Tone Laser Color Printer*, Journal of Imaging Technology, Vol. 14, No. 3, June 1988, which is hereby incorporated herein by reference. As previously indicated herein, a description of some of the details of conventional electronic printing methods comprising scanning a recording element with high energy beams such as light emitting diodes or laser beams, are set forth in Hioki U.S. Pat. No. 5,126,235, European Patent Applications 479 167 A1 and 502 508 A1, the disclosures of which are hereby incorporated herein by reference.

A suitable multicolor, multilayer format for a recording element used in the high speed optical printer and in the electronic printing method of this invention is represented by Structure I.

| STRUCTURE I |
|---|
| Blue-sensitized |
| yellow dye image-forming silver halide emulsion unit |
| Interlayer |
| Green-sensitized |
| magenta dye image-forming silver halide emulsion unit |
| Interlayer |
| Red-sensitized |
| cyan dye image-forming silver halide emulsion unit |
| ///// Support ///// |

wherein the red-sensitized, cyan dye image-forming silver halide emulsion unit is situated nearest the support; next in order is the green-sensitized, magenta dye image-forming unit, followed by the uppermost blue-sensitized, yellow dye image-forming unit. The image-forming units are typically separated from each other by interlayers, as shown.

In the practice of the present invention, a silver bromide rich phase localized at the corners and edges of the host grains high silver chloride emulsion in reactive association with a dye image-forming compound can be contained in the red-sensitized silver halide emulsion unit only, or it can be contained in each of the silver halide emulsion units.

Another useful multicolor, multilayer format for an element of the invention is the so-called inverted layer order represented by Structure II.

| STRUCTURE II |
|---|
| Green-sensitized |
| magenta dye image-forming silver halide emulsion unit |
| Interlayer |
| Red-sensitized |
| cyan dye image-forming silver halide emulsion unit |
| Interlayer |
| Blue-sensitized |
| yellow dye image-forming silver halide emulsion unit |
| ///// Support ///// |

wherein the blue-sensitized, yellow dye image-forming silver halide unit is situated nearest the support, followed next by the red-sensitized, cyan dye image-forming unit, and uppermost the green-sensitized, magenta dye image-forming unit. As shown, the individual units are typically separated from one another by interlayers.

As described above for Structure I, a silver chloride emulsion comprising of silver bromide rich phases localized at the corners and edges of the host grains can be located in the red-sensitized silver halide emulsion unit, or it can be in each of the units.

Still another suitable multicolor, multilayer format for an element of the invention is illustrated by Structure III.

| STRUCTURE III |
|---|
| Red-sensitized |
| cyan dye image-forming silver halide emulsion unit |
| Interlayer |
| Green-sensitized |
| magenta dye image-forming silver halide emulsion unit |
| Interlayer |
| Blue-sensitized |
| yellow dye image-forming silver halide emulsion unit |
| ///// Support ///// |

wherein the blue-sensitized, yellow dye image-forming silver halide unit is situated nearest the support, followed next by the green-sensitized, magenta dye image-forming unit, and uppermost the red-sensitized, cyan dye image-forming unit. As shown, the individual units are typically separated from one another by interlayers.

As described above for Structures I and II, a silver chloride emulsion comprising of silver bromide rich phases localized at the corners and edges of the host grains can be located in the red-sensitized silver halide emulsion unit, or it can be in each of the units.

Three additional useful multicolor, multilayer formats are represented by Structures IV, V, and VI.

| STRUCTURE IV |
|---|
| $IR^1$ - sensitized |
| yellow dye image-forming silver halide emulsion unit |
| Interlayer |
| $IR^2$ - sensitized |
| magenta dye image-forming silver halide emulsion unit |
| Interlayer |
| $IR^3$ - sensitized |
| cyan dye image-forming silver halide emulsion unit |
| ///// Support ///// |

| STRUCTURE V |
|---|
| $IR^1$ - sensitized |
| magenta dye image-forming silver halide emulsion unit |
| Interlayer |
| $IR^2$ - sensitized |
| cyan dye image-forming silver halide emulsion unit |
| Interlayer |
| $IR^3$ - sensitized |
| yellow dye image-forming silver halide emulsion unit |
| ///// Support ///// |

| STRUCTURE VI |
|---|
| $IR^1$ - sensitized |
| cyan dye image-forming silver halide emulsion unit |
| Interlayer |
| $IR^2$ - sensitized |
| magenta dye image-forming silver halide emulsion unit |
| Interlayer |
| $IR^3$ - sensitized |
| yellow dye image-forming silver halide emulsion unit |
| ///// Support ///// |

Structures IV, V, and VI are analogous to the above-described Structures I, II and III, respectively, except that the three emulsion units are sensitized to different regions of the infrared (IR) spectrum. Alternatively, only one or two of the emulsion units in Structures IV, V, and VI may be IR-sensitized, the remaining unit(s) being sensitized in the visible. As with Structures I, II, and III, Structures IV, V, and VI may contain silver chloride emulsion comprising of silver bromide rich phases localized at the corners and edges of the host grains in the lowermost silver halide emulsion unit, or in the lowermost emulsion unit, or in each of the silver halide emulsion units. Also, as previously discussed, the emulsion units of Structures I–VI can individually comprise a multiplicity of silver halide emulsion layers of differing sensitivity and grain morphology.

EXAMPLES

The invention can be better appreciated by reference to the following Examples. Emulsion Examples A through D illustrate the preparation of radiation sensitive high chloride emulsions, both for comparison and inventive emulsions. The term "low methionine gelatin" is employed, except as otherwise indicated, to designate gelatin that has been treated with an oxidizing agent to reduce its methionine content to less than 30 micromoles per gram. Examples 1 through 6 illustrate that recording elements containing layers of such emulsions exhibit characteristics which make them particularly useful in a very fast optical printers and in electronic printing methods of the type described herein.

EMULSION PRECIPITATIONS

Emulsion A

This emulsion demonstrates the conventional, cubic grain emulsion precipitated in non oxidized gelatin with iridium dopant.

A reaction vessel contained 5.39 L of a solution that was 3.9% in regular gelatin, 0.081Min NaCl and contained 1.2 mL of Nalco 2341 antifoaming agent and 1.13 g of thioether ripener. The contents of the reaction vessel were maintained at 46° C., and the pCl was adjusted to 1.7. To this stirred solution at 46° C. was added simultaneously and at 166 mL/min each, 3320 mL of a solution 2.8M in $AgNO_3$ and solution 2.8M in NaCl. Silver nitrate solution contained $3\times10^{-6}$ mole of mercuric chloride per mole of silver. Then 83 mL of 2.8M silver nitrate and 83 mL of a 2.88M sodium chloride contained 0.55 g potassium hexachloridate (III) were added simultaneously at a rate of 166 mL/min each. The 2.8M silver nitrate solution and 2.8M sodium chlorite solution were then added simultaneously at 166 mL/min for 1 minute. Then the emulsion was cooled down to 40° C. over 8 minutes. The resulting emulsion was a cubic grain silver chloride emulsion of 0.4 Nm in edgelength size. The emulsion was then washed using an ultrafiltration unit, and its final pH and pCl were adjusted to 5.6 and 1.8, respectively.

Emulsion B

This emulsion demonstrates the conventional, cubic grain emulsion precipitated in non oxidized gelatin without any dopants.

A pure chloride silver halide emulsion was precipitated by equimolar addition of silver nitrate and sodium chloride solution into a well-stirred reactor containing gelatin peptizer and an antifoaming pluronic agent.

A 5700 mL solution containing 3.9 percent by weight of regular gelatin, 0.014 mol/L of sodium chloride, 0.5 g/L of pluronic 31R1 and 1.44 g of thioether ripener was provided in a stirred reaction vessel. The contents of the reaction vessel were maintained at 46° C., and the pCl was adjusted to 1.7.

While this solution was vigorously stirred, 5104.5 ml of 2.0M silver nitrate solution and 5104.5 mL of a 2.00M sodium chloride were added simultaneously at a rate of 249 mL/min each. The emulsion was then washed using an ultrafiltration unit, and its final pH and pCl were adjusted to 5.6 and 1.8, respectively.

The resulting emulsion was a cubic grain silver chloride emulsion of 0.4 μm in edgelength size. The emulsion was then washed using an ultrafiltration unit, and its final pH and pCl were adjusted to 5.6 and 1.8, respectively.

Emulsion C

This emulsion demonstrates the conventional, cubic grain emulsion precipitated in oxidized gelatin and containing 5 μg $Cs_2Os(NO)Cl_3$ per mole of silver chloride.

A pure chloride silver halide emulsion was precipitated by equimolar addition of silver nitrate and sodium chloride solution into a well-stirred reactor containing low methionine gelatin peptizer. Silver nitrate solution contained $3\times10^{-7}$ mole of mercuric chloride per mole of silver and 5 μg of $Cs_2Os(NO)Cl_3$ per mole of silver was added during precipitation. Total precipitation time of 60 minutes yielded cubic shaped grains of 0.40 μm in edgelength size. The emulsion was then washed using an ultrafiltration unit, and its final pH and pCl were adjusted to 5.6 and 1.8, respectively.

Emulsion D

This emulsion demonstrates the conventional, cubic grain emulsion precipitated in oxidized gelatin and containing 20 μg $Cs_2Os(NO)Cl_3$ per mole of silver chloride.

A pure chloride silver halide emulsion was precipitated by equimolar addition of silver nitrate and sodium chloride solution into a well stirred reactor containing low methionine gelatin peptizer. Silver nitrate solution contained 3×10–7 mole of mercuric chloride per mole of silver and 20 μg of $Cs_2Os(NO)Cl_3$ per mole of silver was added during precipitation. Total precipitation time of 60 minutes yielded cubic shaped grains of 0.40 μm in edgelength size. The emulsion was then washed using an ultrafiltration unit, and its final pH and pCl were adjusted to 5.6 and 1.8, respectively.

Emulsion E

This emulsion demonstrates the conventional, small grain cubic emulsion precipitated in non-oxidizing gelatin and containing 0.3 mole percent of added iodide.

A pure chloride silver halide emulsion was precipitated by equimolar addition of silver nitrate and sodium chloride solution into a well-stirred reactor containing gelatin peptaizer and thioether ripener. Silver nitrate solution contained $3\times10^{-7}$ mole of mercuric chloride per mole of silver. After 93 mole percent of total silver was precipitated, 200 mL of solution containing potassium iodide in an amount corresponding to 0.3 mole percent of total silver precipitated was dumped to the reactor. Total precipitation time of 21 minutes yielded cubic-shaped grains of 0.40 μm in edgelength size. The emulsion was then washed using an ultrafiltration unit, and final pH and pCl were adjusted to 5.5 and 1.8 respectively.

SENSITIZATION OF EMULSIONS

The emulsions were each optimally sensitized by the customary techniques using two basic sensitization schemes. The sequence of chemical sensitizers, spectral sensitizers, soluble bromide and antifoggants addition are the same for each finished emulsion; however, finish temperature profile varied depending on particular emulsion being sensitized. In each case, colloidal gold sulfide was used for chemical sensitization. Detailed procedures are described in the Examples below.

The following red sensitizing dye was used:

Dye SS-1

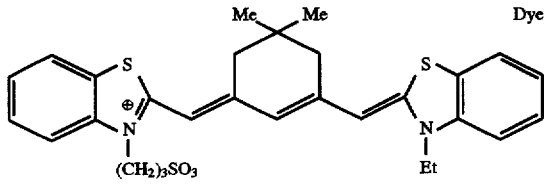

Just prior to coating on resin coated paper support red sensitized emulsions were dual-mixed with cyan dye forming coupler:

Coupler 1

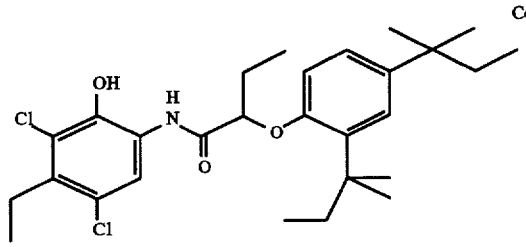

PHOTOGRAPHIC COMPARISONS

All emulsions were coated at 17 mg silver per square foot on resin-coated paper support. The coatings were overcoated with gelatin layer and the entire coating was hardened with bis(vinylsulfonylmethyl)ether.

Coatings were exposed through a step wedge with 3000° K. tungsten source at high-intensity short exposure times ($10^{-4}$ or $10^{-5}$ second) or low-intensity, long exposure time of $10^{-2}$ second. The total energy of each exposure was kept at a constant level. Speed is reported as relative log speed at specified level above the minimum density as presented in the following Examples. In relative log speed units a speed difference of 30, for example, is a difference of 0.30 log E, where E is exposure in lux-seconds. These exposures will be referred to as "Optical Sensitivity" in the following Examples.

Coatings were also exposed with Toshiba TOLD 9140™ exposure apparatus at 685 nm, a resolution of 176.8 pixels/cm, a pixel pitch of 50.8 μm, and the exposure time of 0.05 microsecond per pixel. These exposures will be referred to as "Digital Sensitivity" in the following Examples:

All coatings were processed in Kodak™ Ektacolor RA-4 processing. Relative speeds were reported at Dmin+0.15 and Dmin+1.95 density levels.

Example 1

This example compares effects of different finish temperature profile on shoulder reciprocity failure. In each case, silver chloride cubic emulsions precipitated in non-oxidized gelatin, doped with iridium compound in precipitation and sensitized for red color record was used. The sensitization details were as follows:

Part 1.1: A portion of silver chloride Emulsion A was optimally sensitized by the addition of the optimum amount of colloidal gold-sulfide followed by heat ramp up to 65° C. for 30 minutes and subsequent addition of 1-(3-acetomidophenyl)-5-mercaptotetrazole followed by addition of potassium bromide. Then emulsion was cooled to 40° C. and SS-1 sensitizing dye was added.

Part 1.2: A portion of silver chloride Emulsion A was optimally sensitized by addition of optimum amount of colloidal gold-sulfide followed by heat ramp up to 65° C. for 30 minutes. Then emulsion was cooled to 40° C.

and 1-(3-acetomidophenyl)-5-mercaptotetrazole was added followed by addition of potassium bromide and SS-1 sensitizing dye.

Sensitometric data are summarized in Table I.

TABLE I

| | Optical Sensitivity | | | | Digital Sensitivity | |
|---|---|---|---|---|---|---|
| | $10^{-2}$ sec exposure | | $10^{-4}$ sec exposure | | $5 \times 10^{-7}$ sec exposure | |
| Emulsion | Dmin + 0.15 | Dmin + 1.95 | Dmin + 0.15 | Dmin + 1.95 | Dmin + 0.15 | Dmin + 1.95 |
| Part 1.1 (comp.) | 240 | 100 | 223 | 9 | 235 | 100 |
| Part 1.2 (inven.) | 228 | 138 | 213 | 138 | 230 | 228 |

Addition of bromide and antifoggant after the heat ramp (at 40° C.) exhibits large effect on shoulder speed reciprocity measured at density $D_{min}$+1.95 for conventional optical ($10^{-2}$ sec), short optical ($10^{-4}$ sec), and laser exposures. Addition of bromide at lower temperature improves contrast for all exposure times shown here.

Example 2

This example compares effects of different finish temperature profile on shoulder reciprocity failure. In each case, silver chloride cubic emulsions precipitated in non-oxidized gelatin, and doped with iridium compound in the finish and sensitized for red color record was used. The sensitization details were as follows:

Part 2.1: A portion of silver chloride Emulsion B was optimally sensitized by addition of optimum amount of colloidal gold-sulfide followed by heat ramp up to 65° C. for 30 minutes and subsequent addition of 1-(3-acetomidophenyl)-5-mercaptotetrazole followed by addition of potassium hexachloridate (IV) and potassium bromide. Then the emulsion was cooled to 40° C. and SS-1 sensitizing dye was added.

Part 2.2: A portion of silver chloride Emulsion B was optimally sensitized by addition of an optimum amount of colloidal gold-sulfide followed by heat ramp up to 65° C. for 30 minutes. Then emulsion was cooled to 40° C. and 1-(3-acetomidophenyl)-5-mercaptotetrazole was added followed by addition of potassium hexachloridate (IV), potassium bromide and SS-1 sensitizing dye.

Sensitometric data are summarized in Table II.

TABLE II

| | Optical Sensitivity | | | | Digital Sensitivity | |
|---|---|---|---|---|---|---|
| | $10^{-2}$ sec exposure | | $10^{-4}$ sec exposure | | $5 \times 10^{-7}$ sec exposure | |
| Emulsion | Dmin + 0.15 | Dmin + 1.95 | Dmin + 0.15 | Dmin + 1.95 | Dmin + 0.15 | Dmin + 1.95 |
| Part 2.1 (comp.) | 245 | 100 | 210 | 42 | 182 | 100 |
| Part 2.2 (inven.) | 200 | 79 | 183 | 52 | 168 | 123 |

It is well known that a presence of iridium in the finish significantly improves reciprocity characteristics. In this example effect of addition of bromide after the heat ramp (at 40° C.) in the presence of iridium in the finish is examined. Addition of bromide after the heat ramp exhibits significant effect on shoulder speed reciprocity measured at density $D_{min}$+1.95 both for short optical ($10^{-4}$ sec) and laser exposures. Addition of bromide at lower temperature sharpen the toe and improves contrast for all exposure times shown here.

Example 3

This example compares digestion temperature for silver chloride cubic emulsions precipitated in nonoxidized gelatin, and doped with iridium compound during precipitation and sensitized for red color record. The sensitization details were as follows:

Part 3.1: A portion of silver chloride Emulsion A was optimally sensitized by addition of optimum amount of colloidal gold-sulfide followed by heat ramp up to 65° C. for 30 minutes. Then emulsion was heated up 75° C. followed by subsequent addition of 1-(3-acetomidophenyl)-5-mercaptotetrazole and potassium bromide. Then emulsion was cooled to 40° C. and SS-1 sensitizing dye was added.

Part 3.2: A portion of silver chloride Emulsion A was sensitized identically as in Part 3.1, except that 1-(3-acetomidophenyl)-5-mercaptotetrazole and potassium bromide were added at 65° C.

Part 3.3: A portion of silver chloride Emulsion A was sensitized identically as in Part 3.1, except that followed emulsion hold at 65° C. for 30 minutes, emulsion was cooled down to 55° C.

Part 3.4: A portion of silver chloride Emulsion A was sensitized identically as in Part 3.1, except that followed emulsion hold at 65° C. for 30 minutes, emulsion was cooled down to 45° C.

Part 3.5: A portion of silver chloride Emulsion A was sensitized identically as in Part 3.1, except that followed emulsion hold at 65° C. for 30 minutes, emulsion was cooled down to 40° C.

Part 3.6: A portion of silver chloride Emulsion A was sensitized identically as in Part 3.1, except that followed emulsion hold at 65° C. for 30 minutes, emulsion was cooled down to 30° C.

Sensitometric data are summarized in Table III.

TABLE III

| | Optical Sensitivity | | | | Digital Sensitivity | |
|---|---|---|---|---|---|---|
| | $10^{-2}$ sec exposure | | $10^{-4}$ sec exposure | | $5 \times 10^{-7}$ sec exposure | |
| Emulsion | Dmin + 0.15 | Dmin + 1.95 | Dmin + 0.15 | Dmin + 1.95 | Dmin + 0.15 | Dmin + 1.95 |
| Part 3.1 (comp.) | 165 | 100 | 155 | 17 | 231 | 100 |
| Part 3.2 (comp.) | 164 | 114 | 155 | 41 | 230 | 116 |
| Part 3.3 (inven.) | 157 | 109 | 149 | 78 | 225 | 151 |
| Part 3.4 (inven.) | 159 | 110 | 152 | 100 | 228 | 169 |
| Part 3.5 (inven.) | 162 | 115 | 155 | 105 | 238 | 174 |
| Part 3.6 (inven.) | 163 | 121 | 160 | 115 | 236 | 175 |

The data clearly indicate that addition of bromide at temperatures higher than about 55° C. results in very substantial reduction of shoulder speed reciprocity for exposure times lower than $10^{-4}$ sec. The lower the exposure time, the more substantial is the effect of bromide temperature addition on shoulder speed reciprocity. Addition of bromide at lower temperature improves contrast for all exposure times shown here.

Example 4

In this example addition of 1-(3-acetomidophenyl)-5-mercaptotetrazole and potassium bromide was split to 65° C. and 40° C. This example compares effects of percent of 1-(3-acetomidophenyl)-5-mercaptotetrazole and potassium bromide added at 65° C. on shouder reciprocity. This comparison was done for silver chloride cubic emulsions precipitated in non-oxidized gelatin, and doped with iridium compound in the make and sensitized for red color record. The sensitization details were as follows:

Part 4.1: A portion of silver chloride Emulsion A was optimally sensitized by addition of optimum amount of colloidal gold-sulfide followed by heat ramp up to 65° C. for 30 minutes and subsequent addition of 1-(3-acetomidophenyl)-5-mercaptotetrazole followed by addition of potassium bromide. Then emulsion was cooled to 40° C. and SS-1 sensitizing dye was added.

Part 4.2: A portion of silver chloride Emulsion A was sensitized identically as in Part 4.1, except that following the emulsion hold at 65° C. for 30 minutes, only 75% of 1, 1-(3-acetomidophelyn)-5-mercaptotetrazole and potassium bromide were added at 65° C. Then emulsion was cooled down to 40° C. and remaining 25% of 1-(3-acetomidophenyl)-5-mercaptotetrazole and potassium bromide were added followed by the addition of SS-1 sensitizing dye.

Part 4.3: A portion of silver chloride Emulsion A was sensitized identically as in Part 4.1, except that following emulsion hold at 65° C. for 30 minutes, only 50% of 1, 1-(3-acetomidophenyl)-5-mercaptotetrazole and potassium bromide were added at 65° C. Then emulsion was cooled down to 40° C. and remaining 50% of 1-(3-acetomidophenyl)-5-mercaptotetrazole and potassium bromide were added followed by the addition of SS-1 sensitizing dye.

Part 4.4: A portion of silver chloride Emulsion A was sensitized identically as in Part 4.1, except that following emulsion hold at 65° C. for 30 minutes, only 25% of 1, 1-(3-acetomidophenyl)-5-mercaptotetrazole and potassium bromide were added at 65° C. Then emulsion was cooled down to 40° C. and remaining 75% of 1-(3-acetomidophenyl)-5-mercaptotetrazole and potassium bromide were added followed by the addition of SS-1 sensitizing dye.

Part 4.5: A portion of silver chloride Emulsion A was optimally sensitized by addition of optimum amount of colloidal gold-sulfide followed by heat ramp up to 65° C. for 30 minutes. Then emulsion was cooled to 40° C. and 1-(3-acetomidophenyl)-5-mercaptotetrazole was added followed by the addition of potassium bromide and SS-1 sensitizing dye.

Sensitometric data are summarized in Table IV.

TABLE IV

| | Optical Sensitivity | | | | Digital Sensitivity | |
|---|---|---|---|---|---|---|
| | $10^{-2}$ sec exposure | | $10^{-4}$ sec exposure | | $5 \times 10^{-7}$ sec exposure | |
| Emulsion | Dmin + 0.15 | Dmin + 1.95 | Dmin + 0.15 | Dmin + 1.95 | Dmin + 0.15 | Dmin + 1.95 |
| Part 4.1 (comp.) | 161 | 100 | 147 | 20 | 200 | 100 |
| Part 4.2 (inven.) | 163 | 103 | 151 | 78 | 201 | 137 |
| Part 4.3 (inven.) | 162 | 104 | 151 | 86 | 202 | 146 |
| Part 4.4 (inven.) | 158 | 103 | 149 | 89 | 202 | 150 |
| Part 4.5 (inven.) | 175 | 106 | 148 | 89 | 202 | 150 |

The data clearly indicates the modification of the position of the addition of bromide and antifoggant to after the heat digestion results in very substantial reduction of shouder speed reciprocity failure for exposure times lower than $10^{-4}$ sec. The lower the exposure time the more substantial is the effect of bromide and antifoggant temperature addition modification on shoulder speed reciprocity.

Example 5

This example compares effects of different finish temperature profile on shoulder reciprocity failure. In each case, silver chloride cubic emulsions precipitated in oxidized gelatin, doped with $Cs_2Os(NO)Cl_3$ compound in the make and sensitized for red color record was used. The sensitization details were as follows:

Part 5.1: A portion of silver chloride Emulsion C was optimally sensitized by addition of optimum amount of colloidal gold-sulfide followed by heat ramp up to 65° C. for 30 minutes and subsequent addition of 1-(3-acetomidophenyl)-5-mercaptotetrazole followed by addition of potassium bromide. Then emulsion was cooled to 40° C. and SS-1 sensitizing dye was added.

Part 5.2: A portion of silver chloride Emulsion C was optimally sensitized by addition of optimum amount of colloidal gold-sulfide followed by heat ramp up to 65° C. for 30 minutes. Then emulsion was cooled to 40° C. and 1-(3-acetomidophenyl)-5-mercaptotetrazole was added followed by addition of potassium bromide and SS-1 sensitizing dye.

Part 5.3: A portion of silver chloride Emulsion D was sensitized identically as in Part 5.1.

Part 5.4: A portion of silver chloride Emulsion D was sensitized identically as in Part 5.2.

Sensitometric data are summarized in Table V.

TABLE V

| | Optical Sensitivity | | | | Digital Sensitivity | |
|---|---|---|---|---|---|---|
| | $10^{-2}$ sec exposure | | $10^{-4}$ sec exposure | | $5 \times 10^{-7}$ sec exposure | |
| Emulsion | Dmin + 0.15 | Dmin + 1.95 | Dmin + 0.15 | Dmin + 1.95 | Dmin + 0.15 | Dmin + 1.95 |
| Part 5.1 (comp.) | 221 | 100 | 207 | 36 | 217 | 100 |
| Part 5.2 (inven.) | 166 | 78 | 157 | 75 | 193 | 149 |
| Part 5.3 (comp.) | 164 | 76 | 218 | 20 | 137 | 84 |
| Part 5.4 (inven.) | 123 | 55 | 116 | 52 | 170 | 138 |

Addition of bromide and antifoggant after the heat ramp (at 40° C.) exhibits large effect on shoulder speed reciprocity measured at density $D_{min}$+1.95 both for conventional optical ($10^{-2}$ sec), short optical ($10^{-4}$ sec) and laser exposures. Addition of bromide at lower temperature improves contrast for all exposure times shown here.

Example 6

This example compares effects of different finish temperature profile on shoulder reciprocity failure. In each case, silver chloride cubic emulsions precipitated in non oxidized gelatin, doped with iodide compound in precipitation and sensitized for red color record was used. The sensitization details were as follows:

Part 6.1: A portion of silver chloride Emulsion E was optimally sensitized by addition of optimum amount of colloidal gold-sulfide followed by heat ramp up to 65° C. for 30 minutes and subsequent addition of 1-(3-acetomidophenyl)-5-mercaptotetrazole followed by addition of potassium bromide. Then emulsion was cooled to 40° C. and SS-1 sensitizing dye was added.

Part 6.2: A portion of silver chloride Emulsion E was optimally sensitized by addition of optimum amount of colloidal gold-sulfide followed by heat ramp up to 65° C. for 30 minutes. Then emulsion was cooled to 40° C. and 1-(3-acetomidophenyl)-5-mercaptotetrazole was added followed by addition of potassium bromide and SS-1 sensitizing dye.

Sensitometric data are summarized in Table VI.

TABLE VI

| | Optical Sensitivity | | | | Digital Sensitivity | |
|---|---|---|---|---|---|---|
| | $10^{-2}$ sec exposure | | $10^{-4}$ sec exposure | | $5 \times 10^{-7}$ sec exposure | |
| Emulsion | Dmin + 0.15 | Dmin + 1.95 | Dmin + 0.15 | Dmin + 1.95 | Dmin + 0.15 | Dmin + 1.95 |
| Part 6.1 (comp.) | 265 | 100 | 254 | 72 | 191 | 100 |
| Part 6.2 (inven.) | 242 | 77 | 200 | 62 | 179 | 121 |

Addition of bromide and antifoggant after the heat ramp (at 40° C.) exhibits large effect on shoulder speed reciprocity measured at density $D_{min}$+1.95 at the extremely short time laser exposures. Addition of bromide at lower temperature sharpen the toe and improves contrast for all exposure times shown here.

Example 7

This example demonstrates a color paper designed for digital exposures in which all three color recording emulsions were digested with potassium bromide added after heat cycle at 40° C.

Silver chloride emulsions were chemically and spectrally sensitized as is described below.

Blue Sensitive Emulsion (Blue EM-1, prepared similarly to that described in U.S. Pat. No. 5,252,451, column 8, lines 55–68): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a shelling without dopant. The resultant emulsion contained cubic shaped grains of 0.76 μm in edgelength size. This emulsion was optimally sensitized by the addition of a colloidal suspension of aurous sulfide and heat ramped up to 60° C., during which time blue sensitizing dye BSD-41-(3-acetamidophenyl)-5-mercaptotetrazole were added. Potassium bromide was then added after cooling of the emulsion to 40° C. In addition, iridium dopant was added during the sensitization process.

Green Sensitive Emulsion (Green EM-1): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a shelling without dopant. The resultant emulsion contained cubic shaped grains of 0.30 μm in edgelength size. This emulsion was optimally sensitized by addition of a colloidal suspension of aurous sulfide, heat digestion, followed by the addition of iridium dopant, cooling to 40° C., addition of Lippmann bromide/1-(3-acetamidophenyl)-5-mercaptotetrazole, green sensitizing dye GSD-1, and 1-(3-acetamidophenyl)-5-mercaptotetrazole.

Red Sensitive Emulsion (Red EM-1): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μm in edgelength size. This emulsion was optimally sensitized by the addition of a colloidal suspension of aurous sulfide followed by a heat ramp, and further additions of 1-(3-acetamidophenyl)-5-mercaptotetrazole, cooling to 40° C. and addition of potassium bromide and red sensitizing dye RSD-1. In addition, iridium and ruthenium dopants were added during the sensitization process.

Coupler dispersions were emulsified by methods well known to the art, and the following layers were coated on a polyethylene resin coated paper support that was sized as described in U.S. Pat. No. 4,994,147 and pH adjusted as described in U.S. Pat. No. 4,917,994. The polyethylene layer coated on the emulsion side of the support contained a mixture of 0.1% (4,4'-bis(5-methyl-2-benzoxazolyl) stilbene and 4,4'-bis(2-benzoxazolyl) stilbene, 12.5% $TiO_2$, and 3% ZnO white pigment. The layers were hardened with bis (vinylsulfonyl methyl) ether at 1.95% of the total gelatin weight.

| Layer 1: Blue Sensitive Layer | |
|---|---|
| Gelatin | 1.528 g/m² |
| Blue Sensitive Silver (Blue EM-1) | 0.253 g Ag/m² |

-continued

| | |
|---|---|
| Y-4 | 0.484 g/m² |
| Dibutyl phthalate | 0.330 g/m² |
| N-tert-butylacrylamide/2-acrylamido-2-methyl-propane sulfonic acid sodium salt (99/1 ratio mixture) | 0.484 g/m² |
| 2,5-Dihydroxy-5-methyl-3-(1-piperidinyl)-2-cyclopenten-1-one | 0.002 g/m² |
| ST-16 | 0.009 g/m² |
| KCl | 0.020 g/m² |
| DYE-1 | 0.009 g/m² |
| Layer 2: Interlayer | |
| Gelatin | 0.753 g/m² |
| Dioctyl hydroquinone | 0.108 g/m² |
| Dibutyl phthalate | 0.308 g/m² |
| Disodium 4,5 Dihydroxy-m-benzenedisulfonate | 0.065 g/m² |
| SF-1 | 0.011 g/m² |
| Irganox 1076 ™ | 0.016 g/m² |
| Layer 3: Green Sensitive Layer | |
| Gelatin | 1.270 g/m² |
| Green Sensitive Silver (Green EM-1) | 0.212 g Ag/m² |
| M-1 | 0.423 g/m² |
| Tris (2-ethylhexyl)phosphate | 0.409 g/m² |
| 2-(2-butoxyethoxy)ethyl acetate | 0.069 g/m² |
| ST-2 | 0.327 g/m² |
| Dioctyl hydroquinone | 0.042 g/m² |
| 1-(3-Benzarnidophenyl)-5-mercaptotetrazole | 0.001 g/m² |
| DYE-2 | 0.006 g/m² |
| KCl | 0.020 g/m² |
| Layer 4: UV Interlayer | |
| Gelat in | 0.822 g/m² |
| UV-1 | 0.060 g/m² |
| UV-2 | 0.342 g/m² |
| Dioctyl hydroquinone | 0.082 g/m² |
| 1,4-Cyclohexylenedimethylene bis (2-ethyl-hexanoate) | 0.157 g/m² |
| Layer 5: Red Sensitive Layer | |
| Gelatin | 1.389 g/m² |
| Red Sensitive Silver (Red EM-1) | 0.187 g Ag/m² |
| C-3 | 0.423 g/m² |
| Dibutyl phthalate | 0.415 g/m² |
| UV-2 | 0.272 g/m² |
| 2-(2-butoxyethoxy)ethyl acetate | 0.035 g/m² |
| Dioctyl hydroquinone | 0.005 g/m² |
| Potassium tolylthiosulfonate | 0.003 g/m² |
| Potassium tolylsulfinate | 0.0003 g/m² |
| Silver phenylmercaptotetrazole | 0.0009 g/m² |
| DYE-3 | 0.023 g/m² |
| Layer 6: UV Overcoat | |
| Gelatin | 0.382 g/m² |
| UV-1 | 0.028 g/m² |
| UV-2 | 0.159 g/m² |
| Dioctyl hydroquinone | 0.038 g/m² |
| 1,4-Cyclohexylenedimethylene bis(2-ethyl-hexanoate) | 0.073 g/m² |
| Layer 7: SOC | |
| Gelatin | 1.076 g/m² |
| Polydimethylsiloxane | 0.027 g/m² |
| SF-1 | 0.009 g/m² |
| SF-2 | 0.0026 g/m² |
| SF-12 | 0.004 g/m² |
| Tergitol 15-S-5 ™ | 0.003 g/m² |

The green layer of the multilayer formulation is modified in the following manner.

Layer 3: Green Sensitive Layer
| | |
|---|---|
| Gelatin | 1.259 g/m$^2$ |
| Green Sensitive Silver (Green EM-1) | 0.145 g Ag/m$^2$ |
| M-2 | 0.258 g/m$^2$ |
| Tris (2-ethylhexyl)phosphate | 0.620 g/m$^2$ |
| ST-5 | 0.599 g/m$^2$ |
| ST-21 | 0.150 g/m$^2$ |
| Dioctyl hydroquinone | 0.095 g/m$^2$ |
| HBAPMT | 0.001 g/m$^2$ |
| KCl | 0.020 g/m$^2$ |
| BIO-1 | 0.010 mg/m$^2$ |
| DYE-2 | 0.006 g/m$^2$ |
STRUCTURES
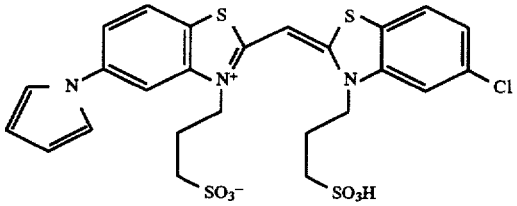
BSD-4
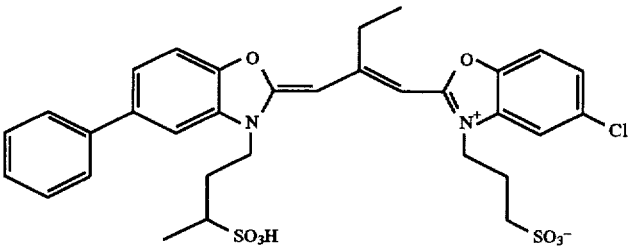
GSD-1
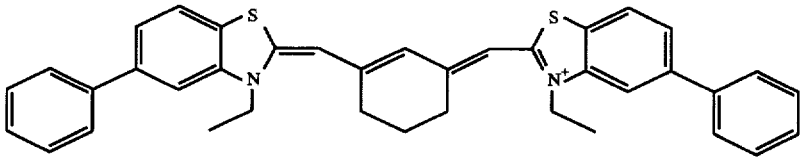
RSD-1
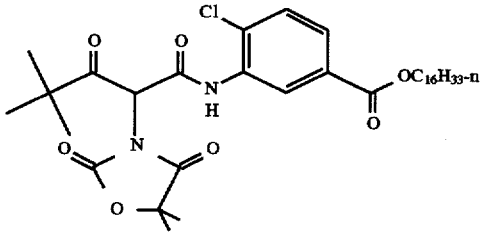
Y-4
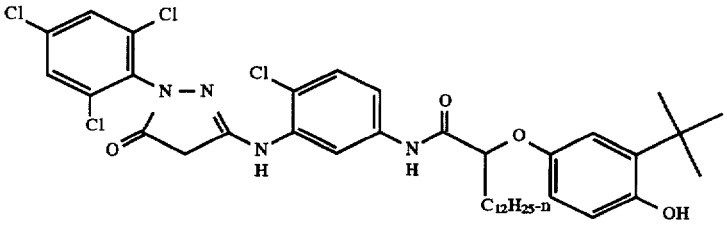
M-1

-continued
M-2
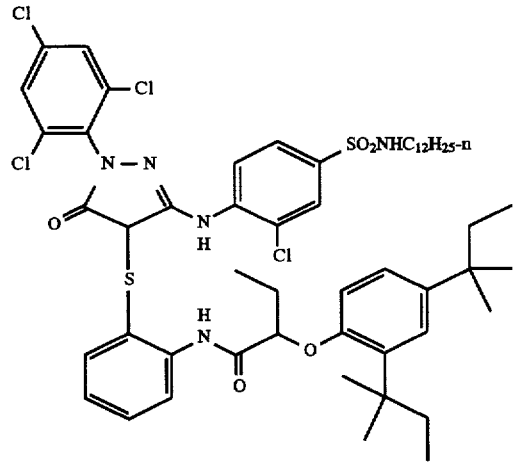
C-1
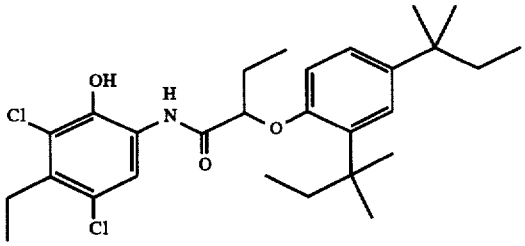
ST-2
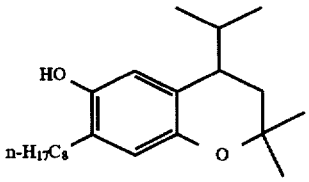
ST-5
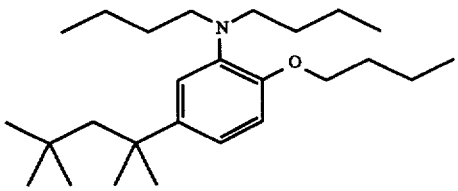
ST-16
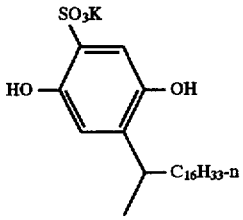
ST-21
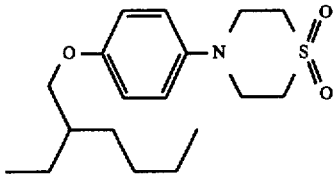

-continued
DYE-1
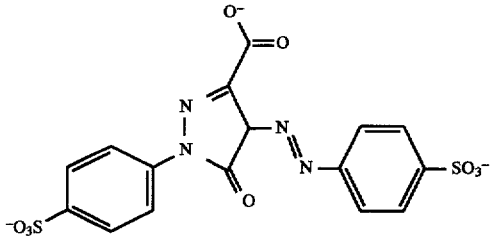
DYE-2
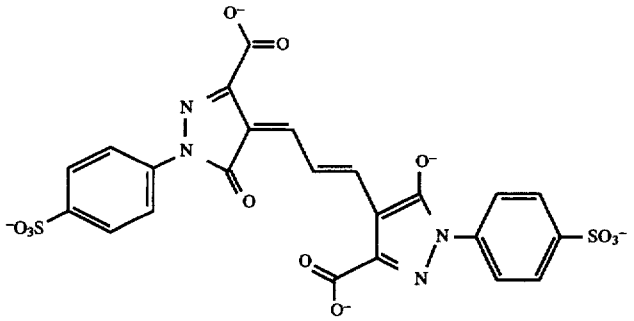
DYE-3
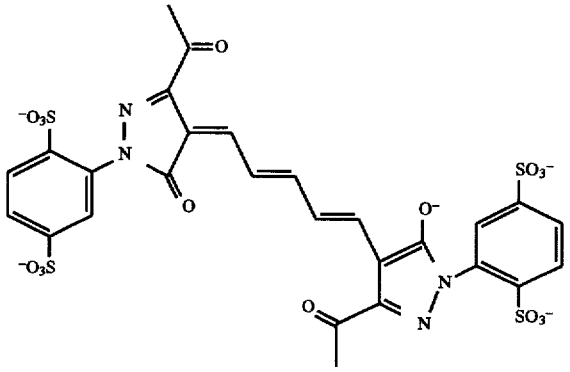
UV-1
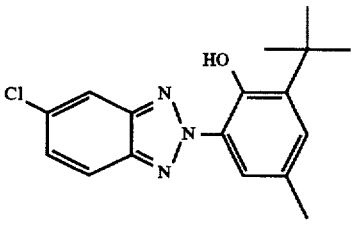
UV-2
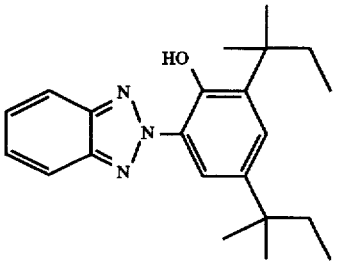

-continued

| | |
|---|---|
| 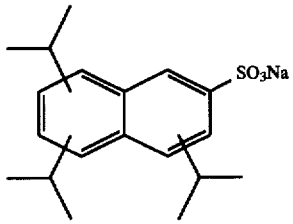 | SF-1 |
| $CF_3(CF_2)_7SO_3Na$ | SF-2 |
| | SF-12 |
| 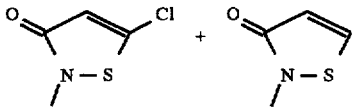 | BIO-1 |

Reciprocity characteristics and overall performance of this paper when exposed by laser was excellent.

The invention has been described in detail with particular reference to preferred embodiments thereof, but it will be understood that variations and modifications can be effected within the spirit and scope of the invention.

We claim:

1. A method of treating silver chloride emulsions comprising providing a silver chloride emulsion, adding gold and sulfur chemical sensitizers, heating to chemically sensitize said emulsion, cooling to below about 50° C., adding bromide to the emulsion and then after bromide addition adding spectral sensitizing dye.

2. The method of claim 1 wherein said dye comprises a red spectral sensitizing or infrared spectral sensitizing dye.

3. The method of claim 1 wherein gold and sulfur sensitizer comprises gold sulfide.

4. The method of claim 3 wherein said gold and sulfur sensitizer is present in an amount of between 0.1 and 200 micromoles per silver mole.

5. The method of claim 3 wherein said bromide is added in an amount of between 0.5 and 2 mole percent per mole of silver.

6. The method of claim 1 wherein said cooling is to between about 35° and 40° C.

7. The method of claim 1 wherein a stabilizing compound is added after said cooling.

8. The method of claim 1 wherein said emulsion comprises cubic grains.

9. The method of claim 1 wherein said bromide is added in an amount of between about 0.5 and about 5 mole percent per mole of silver.

10. The method of claim 9 wherein said bromide deposits as a bromide rich phase on the edges of grains.

11. The method of claim 1 wherein grains of said silver chloride emulsion contain osmium dopant.

12. The method of claim 1 wherein the temperature of addition of said bromide is between 20° and 50° C.

13. The method of claim 1 wherein said silver chloride emulsion is greater than 95 percent chloride.

14. The method of claim 1 wherein said emulsion comprises tabular grains.

15. The method of claim 1 wherein grains of said emulsion contain sulfur dopant.

16. A method of imaging comprising providing a photographic element, wherein said element comprises at least one layer of an emulsion comprising high chloride silver halide grains having gold sulfide on the surface of said grain and a bromide rich phase located at the comers, imaging said element utilizing an exposure time of less than 1 microsecond, and developing said element to produce a photographic image.

17. The method of claim 16 wherein said grains are at least about 95 moles percent silver chloride.

18. The method of claim 17 wherein said grains contain iridium dopant.

19. The method of claim 18 wherein said grains contain osmium dopant.

20. The method of claim 19 wherein said grains contain more than 0.05% iodide.

21. The method of claim 20 wherein said bromide is present in an amount of between about 0.5 and about 5 mole percent per mole of silver.

22. The method of claim 21 wherein said bromide is present in an amount of between 0.5 and 2 mole percent of the moles of silver in the grains of said emulsion.

23. The method of claim 22 wherein said gold sulfide is present in an amount of between about 0.1 micromoles and about 200 micromoles per silver mole.

24. The method of claim 16 wherein said emulsion is in a layer containing a cyan dye forming coupler.

25. The method of claim 16 wherein said exposure is by CRT, LED, laser, or high speed optical printer.

* * * * *